United States Patent [19]

Brady

[11] Patent Number: 4,722,319

[45] Date of Patent: Feb. 2, 1988

[54] ARCHERY BOW BOWSTRING RELEASE DEVICE

[76] Inventor: Welby D. Brady, Rte. 1, Box 82A1, Newberg, Oreg. 97132

[21] Appl. No.: 901,385

[22] Filed: Aug. 28, 1986

[51] Int. Cl.[4] ..... F41C 19/00

[52] U.S. Cl. ..... 124/35 A

[58] Field of Search ..... 124/35 A, 30, 91

[56] References Cited

U.S. PATENT DOCUMENTS

| | | | |
|---|---|---|---|
| 2,637,311 | 5/1953 | Rose | 124/35 A |
| 2,819,707 | 1/1958 | Kayfes et al. | 124/35 |
| 2,965,093 | 12/1960 | Arsenault | 124/35 A |
| 3,672,346 | 6/1972 | Plumb | 124/35 |
| 3,757,763 | 9/1973 | Pinti et al. | 124/35 |
| 3,929,120 | 12/1975 | Barner | 124/35 |
| 3,937,206 | 2/1976 | Wilson | 124/35 |
| 4,004,564 | 1/1977 | Castonguay | 124/35 |
| 4,009,703 | 3/1977 | Cunningham, Sr. | 124/35 |
| 4,041,925 | 8/1977 | Barrick | 124/35 |
| 4,066,060 | 1/1978 | Napier | 124/35 |
| 4,086,904 | 5/1978 | Suski | 124/90 |

*Primary Examiner*—Richard C. Pinkham
*Assistant Examiner*—Benjamin Layno
*Attorney, Agent, or Firm*—Eugene M. Eckelman

[57] ABSTRACT

A body portion has a finger grip aperture therein and a slot on the forward edge arranged to receive a bowstring. A catch assembly pivotally supported on an upright axis extends into the slot and has a first position arranged to hold the bowstring in the release device and a second position arranged to release the bowstring. A trigger is mounted on the top of the body portion and operates an upright pin slidable in the body portion between a first position behind the catch assembly to hold the catch assembly in holding engagement on a bowstring and a second position disengaged from the catch assembly for allowing the latter to pivot and release the bowstring. The front of the body portion has a bore for receiving an arrow nock, such bore being of a size to also receive a bowstring nock stop. The slot which leads in from the front end of the body member is of less width than the bowstring nock stop whereby the release device will hang on the string nock stop for ready use.

3 Claims, 4 Drawing Figures

ARCHERY BOW BOWSTRING RELEASE DEVICE

BACKGROUND OF THE INVENTION

This invention relates to new and useful improvements in archery bow bowstring release devices.

Devices have heretofore been designed which provide a more convenient grip on the bowstring than an actual manual grip. Some of the devices, such as shown in U.S. Pat. Nos. 3,937,206 and 4,004,564 utilize a looped rope portion and rope release for drawing the bowstring. Other devices utilize mechanical engaging catches which draw the bowstring and release it for shooting the arrow. Examples of such mechanical engaging catches are shown in U.S. Pat. Nos. 2,819,707 and 3,757,763. Also, some devices have mechanism for drawing the bowstring and maintaining the bow in drawn condition. An example of this type of structure is shown in U.S. Pat. No. 4,041,925. Furthermore, a device has been conceived as shown in U.S. Pat. No. 4,086,904 which employs an anchor portion attachable to the bowstring and removably attached to the release device whereby when it is desired to draw the bowstring the release device is clipped onto the anchor device.

A need exists for a simplified and economical release device which is efficient in its use and which also is attachable to the bowstring in an arrangement such that a fast and convenient draw of the bowstring can be accomplished.

SUMMARY OF THE INVENTION

According to the present invention and forming a primary objective thereof, an archery bow bowstring release device is provided which accomplishes the above features, namely, such device is simplified in structure, economical to manufacture, and is capable of being hung on the bowstring for quick draw and release of the bowstring.

In carrying out the above objectives, the device employs a body portion having a finger grip aperture therein and a front slot in the forward end for receiving a bowstring. Catch means are pivotally supported in the body member on an upright axis and extend into the slot means. The catch means has a hook end arranged to lock a bowstring in the device but also capable of allowing the bowstring to be readily released. An upright pin slidable in the body member has a first position engaged behind the latter in a latched position, and such pin is operatively connected to a trigger which upon being depressed pulls the pin from behind the catch means to release the bowstring. The forward end of the body member has a bore for receiving the arrow nock and the bowstring nock stop, and important to the invention, the front slot is of less width than the usual string nock stop, whereby with the bowstring locked behind the catch means and the bowstring nock stop disposed in the front bore and restricted from moving in the slot, the device is capable of being hung on the bowstring with an arrow in place for fast use.

The invention will be better understood and additional objects and advantages will become apparent from the following description taken in connection with the accompanying drawings.

DETAILED DESCRIPTION OF A PREFERRED EMBODIMENT

With particular reference to the drawings, the numeral 10 designates a conventional bow and the numeral 12 designates the bowstring. Although not necessary, a feature of the present invention is in combination with a bowstring of the type having a bowstring with a bowstring nock stop 14 secured thereto in a selected location.

Figure 1:
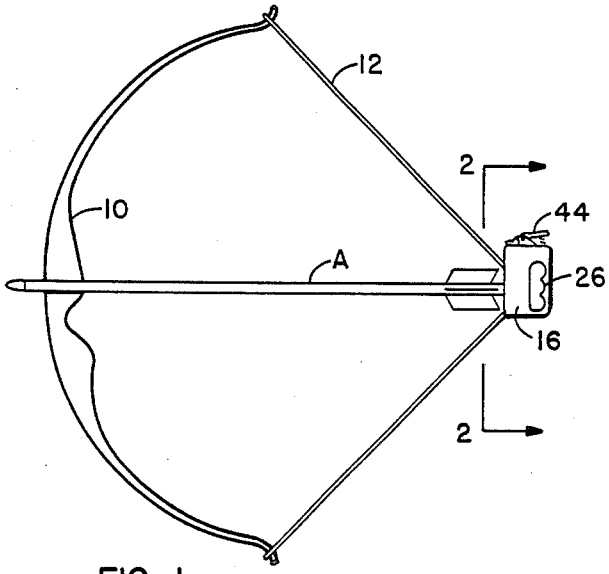
FIG. 1 is a side elevational view of a bow and showing such bow in a drawn position with the present release device attached to the bowstring.
Figure 2:
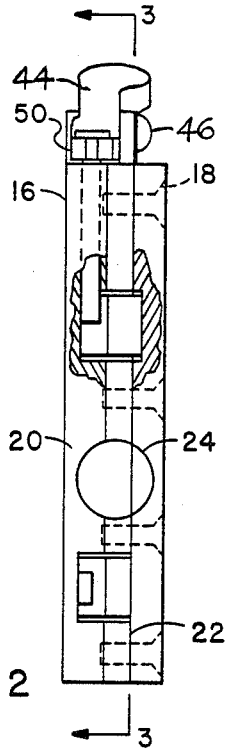
FIG. 2 is a front elevational view of the present release device, taken on the line 2—2 of FIG. 1.
Figure 3:
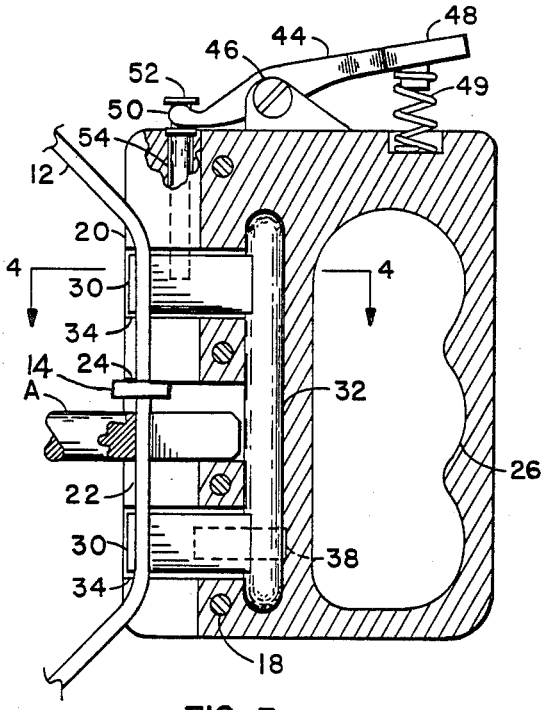
FIG. 3 is an enlarged sectional view taken on the line 3—3 of FIG. 2.
Figure 4:
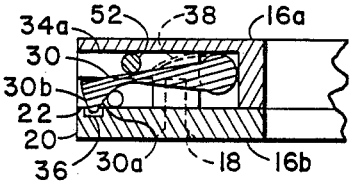
FIG. 4 is a fragmentary sectional view taken on the line 4—4 of FIG. 3.

The present release device comprises a body portion 16 formed of a pair of plate-like portions **16*a* and 16*b*, FIG. 4, clamped together by screws 18. The front edge 20 of the body portion has a slot 22 leading fully from top to bottom and of a width to freely receive the bowstring 12. The front edge 20 also has a round bore 24 leading inwardly and arranged to receive the nock portion of an arrow A. The bore 24 is large enough to receive such arrow nock and also simultaneously to receive the bowstring nock, FIG. 3, stop 14, but the slot 22 is of less width than the nock stop. Body portion 16 has a hand grip opening 26** at a rearward portion thereof, this opening preferably being of a size and shape for gripping by three fingers.

A pair of catches 30 having a hook end **30*a* and a front rounded surface 30*b* are secured integrally to an upright shaft 32 journaled in the body portion rearwardly of the slot 22. The catches 30 are disposed in slots or recesses 34 leading inwardly from the front edge 20 and extending to the shaft 32. Slots 34 have sufficient dimension in their height and width to allow free movement of the catches 30 and also to allow lateral movement across the slot. As best seen in FIG. 4, one side of the slot 22 at the slots 34 has recesses 36 capable of receiving the hook end portion 30*a* of the catches 30. The hooks have movement between two positions, namely, a retracted position with the rear side thereof in engagement with a defining edge 34*a* of slots 34 and a catch position wherein the end portions thereof project into recesses 36. Catches 30 and integrated shaft 32 are urged to a latched position by spring means 38, such as an arched leaf spring, confined in one of the slots 34 between the respective catch and wall of slot 34** on the side of the catch opposite from the hook end. While such spring means biases the hook assembly in such latched position, the force of the spring is not sufficient to prevent release of a bowstring when a trigger mechanism is actuated, as will now be described.

Such trigger mechanism comprises a lever 44 having an intermediate pivot support 46 on the top of the body portion. This lever has a finger tab 48 at one end engaged from underneath by a compression spring 49 which urges the lever in a counterclockwise direction as viewed in FIG. 3. The opposite end of lever 44 from finger tab 48 has a yoke connection 50 with a trigger pin 52 slidably contained in an upright bore 54 in the body portion 10. Bore 52 is precisely located such that, with reference to FIG. 4, the trigger pin 52 in a down position thereof extends closely adjacent wall portion 34*a* of the upper slot 34 and capable of being disposed behind the upper catch 30. This position of the trigger pin 52 positively holds the catch means 30 in a latching position as will be more apparent hereinafter. As stated above, the slot 22 is of sufficient width to freely receive the bowstring. However, this slot is of less width than the usual width of a bowstring nock stop 14 whereby the nock stop will be confined in the bore 24 for a reason to be apparent hereinafter.

For installing the present release device on a bowstring, the trigger lever 44 is depressed which raises the trigger pin 52 above the associated catch 30. With the spring 38 lightly holding the catches 32 closed, the device is pushed onto the bowstring with the latter moving over the rounded ends 30*b* of the catches. The bowstring thus moves behind the hook portions 30*a* of the catches. Thereupon, the trigger lever 44 is released and the spring 49 causes the trigger pin 52 to move down behind the upper catch 30 whereby the catch mechanism locks the release device on the bowstring. When it is desired to draw and release the bowstring, it is merely necessary to depress the trigger lever 44 to raise the pin 52 whereby the bowstring will force the spring pressed catch assembly open and be released therefrom.

In attaching the present release device to the bowstring, the string nock stop 14 moves into the bore 24 along with the arrow nock, and since the slot 22 is of less width than the nock stop 14, the nock stop 14 will abut against the top of the bore 24 and thus the release device will not slide down the bowstring but instead will hang on the nock stop 14 and be conveniently available for drawing the bowstring.

According to the invention, a release device is provided which is simplified in its construction and efficient in operation. It is easily attached to the bowstring, namely, the trigger lever 44 is depressed and the device is pushed onto the bowstring. Furthermore when the device is on the bowstring it is supported by the bowstring nock stop and locked in place. If desired, the release device can be readily disconnected and carried separately.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A bowstring holding and release device comprising a body portion having forward, rearward, top and bottom ends, finger grip means on the rearward end of said body portion, elongated slot means in the forward end of said body portion and extending at least a portion of the distance from top to bottom for receiving a bowstring therein, a bore in the forward end of said body member intersecting said slot means and of a diameter to receive an arrow nock, recess means in the forward end of said body member intersecting said slot means, catch means pivotally supported in said recess means on an upright axis, said catch means extending into said recess means and having a hook end, said catch means having a first position arranged to hold the bowstring in said release device by means of said hook end and having a second position arranged to release the bowstring from said hook end, spring means in said body portion engageable with said catch means for urging it to its first position, and trigger means on said body portion, said trigger means comprising an upright pin slidable in said body portion and having a first position engaged behind said catch means relative to said hook end to hold said hook end in holding engagement on a bowstring and having a second position disposed above said catch means for allowing said catch means to pivot and release a bowstring.

2. The release device of claim 1 wherein said catch means includes a pair of catches spaced in upright relation from each other and an opposite sides of said bore and integrated with an upright shaft pivotally supported in said body member.

3. A bowstring holding and release device for use with a bowstring of the type having a string nock stop secured thereto, comprising a body portion having forward, rearward, top and bottom ends, finger grip means on the rearward end of said body portion, slot means leading in from the forward end of said body portion for receiving a bowstring therein, catch means pivotally supported in said body member on an upright axis, said catch means extending into said slot means and having a hook end, said catch means having a first position arranged to hold the bowstring in said release device by means of said hook end and having a second position arranged to release the bowstring from said hook end, and trigger means on said body portion, said trigger means comprising an upright pin slidable in said body portion and having a first position engaged behind said catch means relative to said hook end to hold said hook end in holding engagement on a bowstring and having a second position disposed above said catch means for allowing said catch means to pivot and release a bowstring, said body member having a bore in its slotted forward end of a diameter to receive both an arrow nock and a string nock stop, said slot means being of less width than a string nock stop such that the latter is restricted from moving from said bore into said slot whereby in the second position of said catch means said release device hangs on said bowstring in a stationary position.

* * * * *